United States Patent [19]

Sulley

[11] Patent Number: 4,646,376

[45] Date of Patent: Mar. 3, 1987

[54] INVERTIBLE COMFORTER

[75] Inventor: Guenther Sulley, Greenville, S.C.

[73] Assignee: Carolina Creations, Inc., Greenville, S.C.

[21] Appl. No.: 811,513

[22] Filed: Dec. 20, 1985

Related U.S. Application Data

[63] Continuation-in-part of Ser. No. 421,976, Sep. 23, 1982.

[51] Int. Cl.[4] ..... A47G 9/02

[52] U.S. Cl. ..... 5/502; 5/482; 5/485; 5/490; D6/596; D6/601; 112/262.1

[58] Field of Search ..... 5/482, 500, 502, 485, 5/490, 413, 53 R, 501; D6/601, 603, 596, 597; 2/DIG. 2; 112/262.1

[56] References Cited

U.S. PATENT DOCUMENTS

| | | | |
|---|---|---|---|
| 2,937,383 | 5/1960 | Rehfeld | 5/482 |
| 3,613,133 | 10/1971 | Isola et al. | 5/502 |
| 4,144,603 | 3/1979 | Schaechter | 5/490 |
| 4,236,263 | 12/1980 | Allee | 5/413 |
| 4,274,169 | 6/1981 | Standiford | 5/502 |

FOREIGN PATENT DOCUMENTS

| | | | |
|---|---|---|---|
| 755077 | 11/1933 | France | 5/485 |

*Primary Examiner*—Alexander Grosz
*Attorney, Agent, or Firm*—Bailey & Hardaway

[57] ABSTRACT

A plurality of novel decorative items for use in various combinations to provide alternatives in bedroom decor, including a novel process for co-ordinating and displaying various combinations of the decorative items; and to provide a novel invertible comforter which may be manually turned to expose its finished interior surfaces via an unstitched length along its bottom edge.

7 Claims, 10 Drawing Figures

Fig. 1.
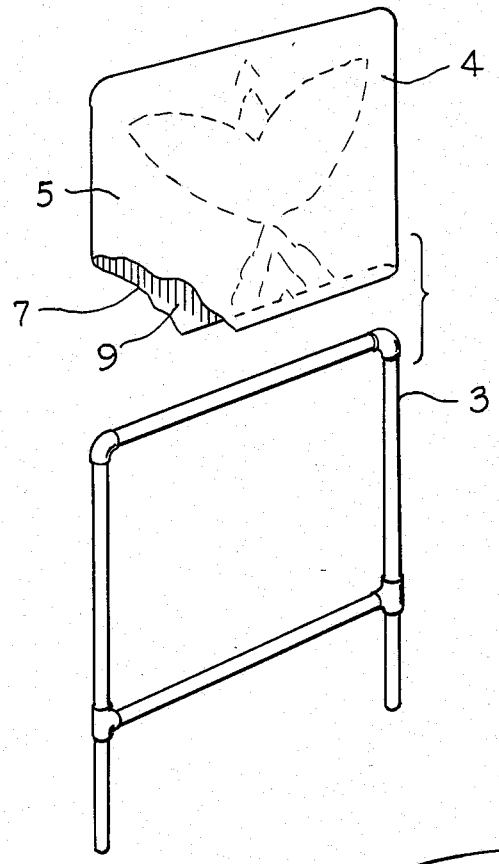
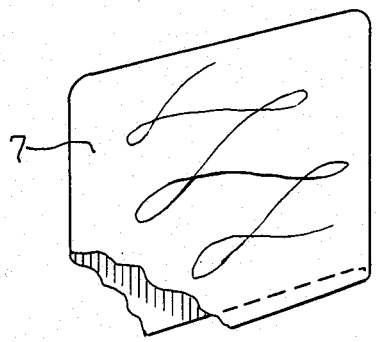
Fig. 2.
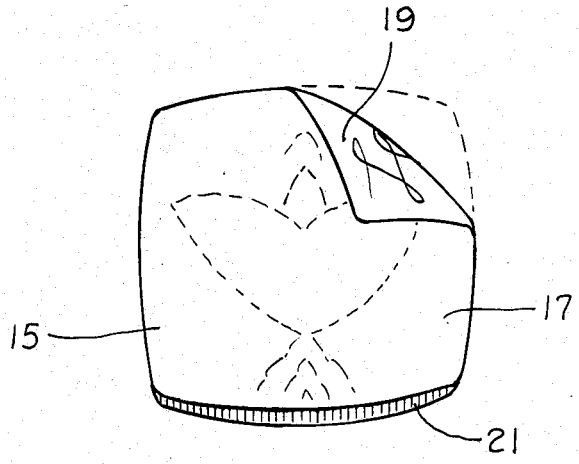
Fig. 3.

Fig. 7.
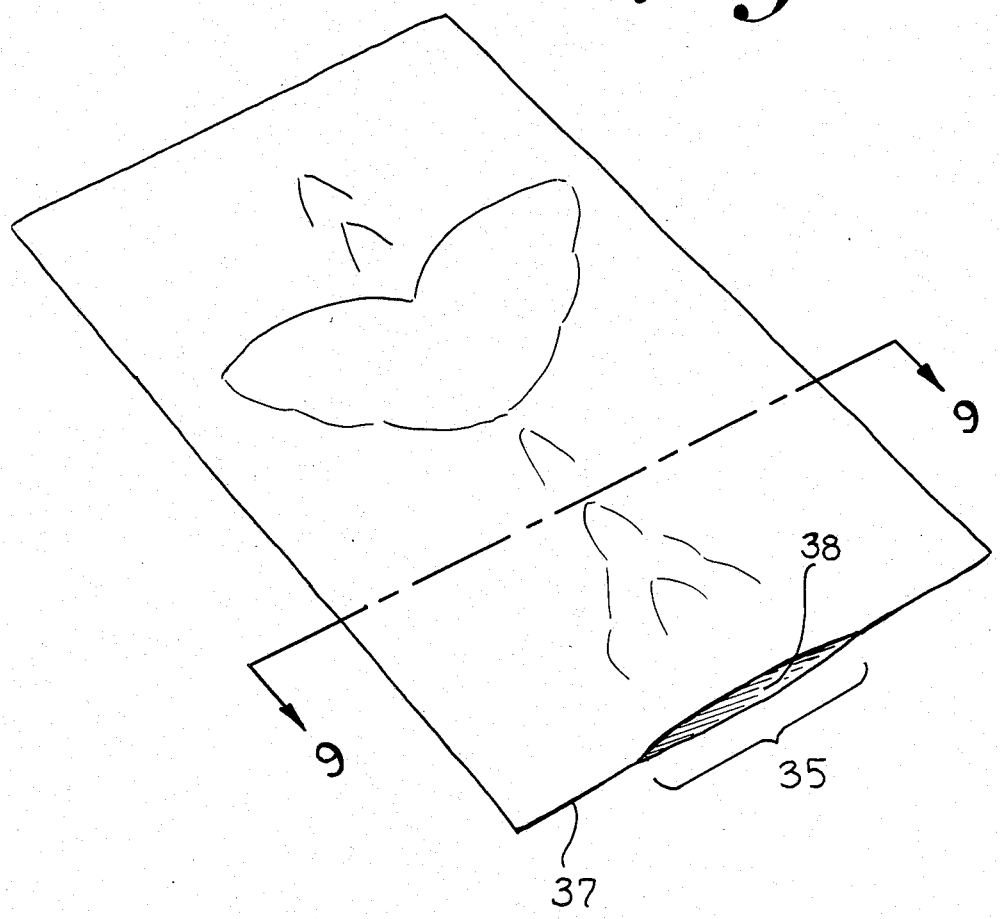
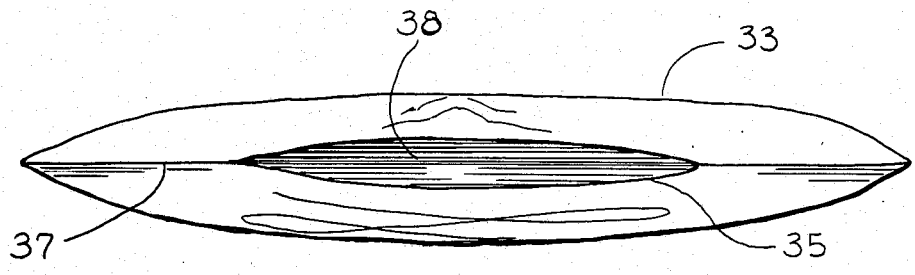
Fig. 8.

INVERTIBLE COMFORTER

CROSS REFERENCE TO RELATED APPLICATION

This application is a continuation-in-part of application Ser. No. 421,976 filed Sept. 23, 1982 still pending.

BACKGROUND OF THE INVENTION

This invention relates generally to the art of decorating, and more particularly to a decorative headboard, pillow shams and an invertible comforter for a conventional bed.

There has been much prior art associated with bedroom decorations and particularly the decorations associated with headboards. For example, U.S. Pat. No. 2,624,891 to Katzoff discloses a changeable headboard which comprises in essence a rigid headboard having a wooden backing member which in turn connects to a sleeve-like structure for enveloping a conventional headboard assembly.

U.S. Pat. No. 2,508,506 to Fridolph discloses a headboard frame assembly with a changeable decorative partition in the center section thereof, and U.S. Pat. No. 2,687,537 to Wallace, et al discloses a similar headboard assembly.

U.S. Pat. No. 571,168 to Jones, U.S. Pat. No. 264,758 to Richardson, and U.S. Pat. No. 3,546,725 to Tambascio disclose other decorative headboards.

SUMMARY OF THE INVENTION

It is thus an object of this invention to provide a plurality of novel decorative items for use in various combinations to provide alternatives in bedroom decor.

It is a further object of this invention to provide a novel process for co-ordinating and displaying various combinations of the decorative items.

It is a still further and more particular object of this invention to provide a novel process of inverting a comforter of novel design by manually turning it to expose its finished interior surfaces via an unstitched length along its bottom edge.

These as well as other objects are accomplished by a plurality of decorative items comprising a headboard, a fabric sleeve for the headboard having frontal and rearward portions, pillow shams for covering ornamental pillows to be placed near the headboard with frontal and rearward portions co-ordinating with the frontal and rearward portions of the headboard sleeve, and a comforter which may be inverted to provide two distinct exterior patterns, one of which co-ordinates with the frontal portions of the sleeve and shams and the other of which co-ordinates with the rearward portions of the sleeve and shams.

Whereas the prior art provides a variety of headboard assemblies and decorative technique therefor, the novel decorative items herein described are significant to the field and noteworthy in accordance with their distinguishing features, including particularly those of a comforter which may be inverted to provide two distinct exterior patterns. As used herein the term 'invert' conforms to the conventional notion of turning inside out. In the instant case, the inversion exposes finished surfaces rather than unfinished surfaces as might be found in the prior art. Other distinguishing features include decorative items having independently quilted and/or embroidered fabric sections and the co-ordination of the ornamental features of headboard sleeve, pillow shams and comforter.

BRIEF DESCRIPTION OF THE DRAWINGS

FIG. 1 of the drawings is a perspective view of the headboard frame and frontal portion of the sleeve therefor in accordance with this invention and that of the co-pending patent application No. 421,976.

FIG. 2 of the drawings is a perspective view of the rearward portion of the sleeve for the headboard in accordance with this invention.

FIG. 3 of the drawings is a perspective view of the contrasting frontal and rearward portions of the pillow sham in accordance with this invention.

FIG. 7 of the drawings is a perspective view of the comforter in accordance with the illustration.

FIG. 8 of the drawings is an end view of the comforter in accordance with this invention.

DETAILED DESCRIPTION OF THE DRAWINGS

Figure 4:
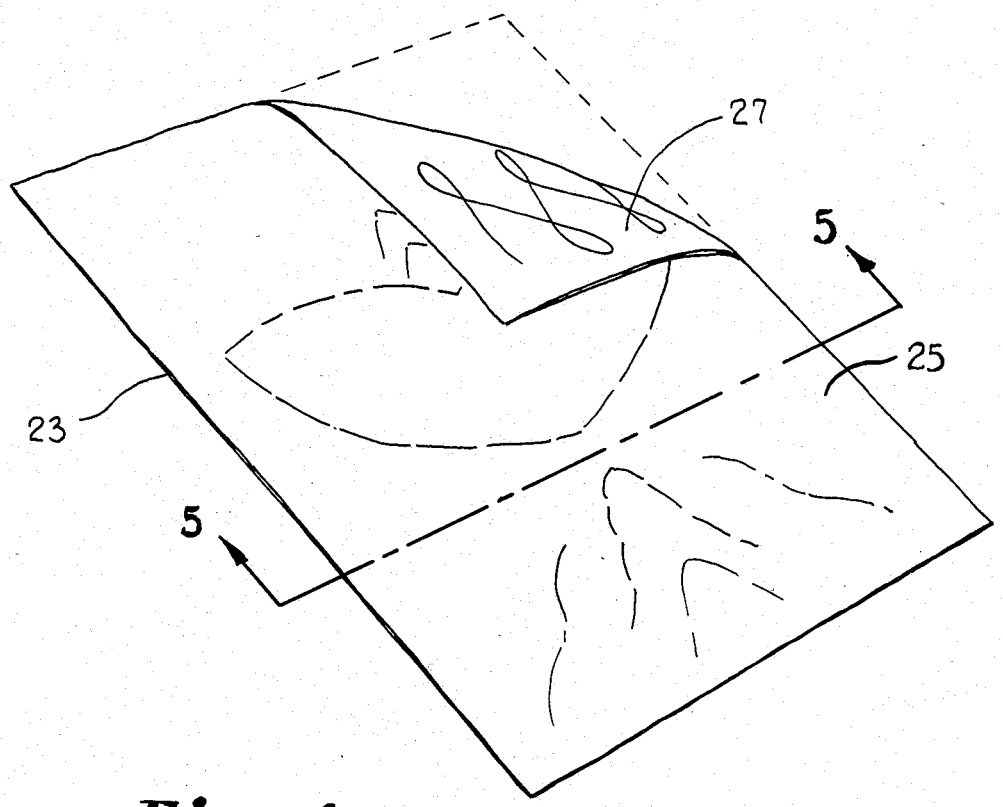
FIG. 4 of the drawings is a perspective view of the contrasting portions of one unit of the comforter in accordance with this invention.

In accordance with this invention it has been found that a plurality of decorative items can be co-ordinated and displayed in various combinations to provide alternatives in bedroom decor. It has been further found that an invertible comforter enhances such decor in that it provides a choice between two distinct designs while also allowing the top portion of the finished comforter to match the bottom portion of the finished comforter so that the edge at the head of the bed may be turned back without disturbing the overall decorative scheme.

The ornamental portions of the decorative items hereinafter described comprise fabric sections which are independently quilted and/or embroidered and then stitched together in the traditional manner in order to produce the desired accessories for a conventional bed. This invention will be further understood from the following description given with reference to the various figures of drawings.

FIG. 1 of the drawings is a perspective view of the headboard frame and sleeve therefor in accordance with this invention and that of co-pending application No. 421,976. The headboard comprises a collapsible frame 3 and a sleeve 4. The sleeve comprises a decorative frontal portion 5 with a decorative rearward portion of defining a cavity 9 therebetween the receipt of collapsible frame 3. Illustrated in FIG. 2 of the drawings is a full view of the rearward portion 7 of the headboard sleeve 1. It is readily apparent that the sleeve could be positioned on the headboard frame to expose either decorative portion 5 or 7 depending upon the color, design and/or stitching pattern required to complement the overall bedroom decor.

FIG. 3 of the drawings illustrates a pillow sham 15 for covering decorative pillows for placement near the headboard of the bed. The pillow sham comprises a decorative frontal portion 17 and a contrasting decorative rearward portion 19 stitched together in the traditional manner to define a cavity 21 therebetween for receipt of a pillow. It can be readily seen that the frontal and rearward portions of the pillow sham co-ordinate respectively with the frontal and rearward portions of the headboard sleeve.

Figure 5:
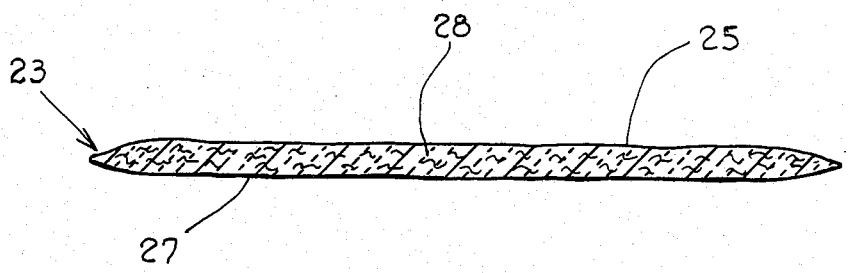
FIG. 5 of the drawings is a cross-sectioned view of one unit of the comforter in accordance with this invention.

FIG. 4 of the drawings illustrates one unit 23 of two like units which comprise the comforter 33 of FIG. 7. The unit comprises an upper quilted and/or embroidered fabric portion 25 and a lower quilted and/or embroidered fabric portion 27 which are stitched to each other along all four edges such that the ornamental features of each are toward the outside. In FIG. 5 of the drawings the cross-sectioned view of unit 23 is seen; the unit is filled with traditional stuffing 28. The finished comforter comprises two such units, the upper and lower fabric portions of each co-ordinating with or matching respectively the upper and lower fabric portions of the other. In addition, as can be seen in FIG. 4, the upper fabric portions of each unit contrast to or differ in color, design and/or stitching patterns from the lower portions of each unit.

Figure 6:
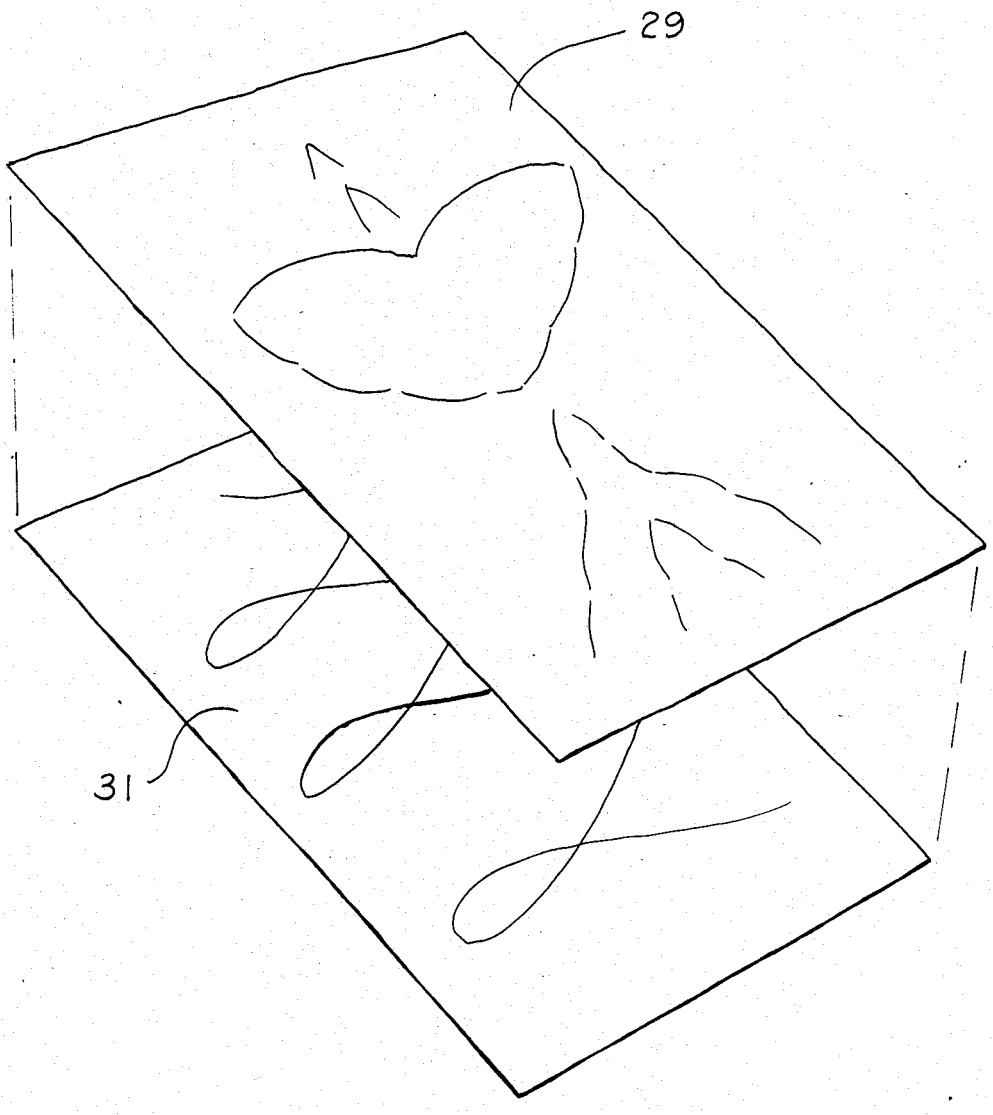
FIG. 6 of the drawings is an assembly view of the comforter comprising two individual units, the lower one of which has been turned over to reverse its top and bottom surfaces in accordance with this invention.

FIG. 6 of the drawings illustrates the construction of the comforter comprising two distinct and like units 29 and 31, whereby the bottommost unit 31 is turned over to reverse its top and bottom surfaces prior to stitching the two units to each other. FIG. 7 of the drawings illustrates the finished comforter 33 after the two units have been stitched to each other along all four edges except for one short length 35 along the edge 37 to be positioned at the foot of the bed. It is seen that the resulting exterior ornamental fabric portions of the finished comforter co-ordinate with or match each other, and likewise the interior ornamental fabric portions of the finished comforter co-ordinate with or match each other. The short length 35 remaining unstitched along edge 37 provides means for inverting the comforter by allowing one to reach through the opening into the cavity 38 and manually turn the comforter to expose the interior ornamental fabric portions. Thus, two distinct exterior patterns are provided, one of which co-ordinates with the frontal portions of the headboard sleeve and pillow shams, and the other of which co-ordinate with the rearward portions of the sleeve and shams.

FIG. 8 illustrates an end view of the finished comforter 33 along the edge 37 to be positioned at the foot of the bed, showing the short unstitched length 35 and the cavity 38 created within.

Figure 9:
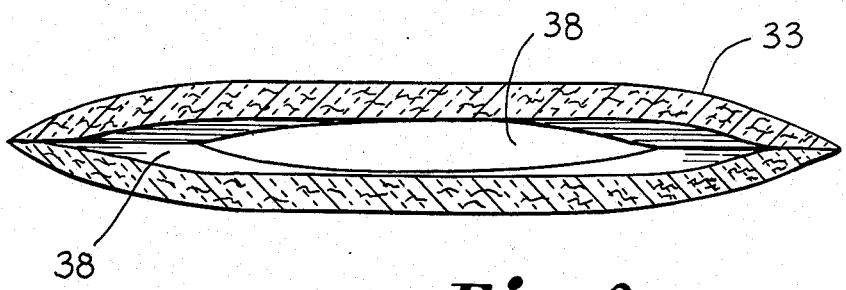
FIG. 9 of the drawings is a cross-sectioned view of the comforter in accordance with the illustration.

FIG. 9 of the drawings shows a cross-sectional view of the finished comforter 33 including the cavity 38 within.

Figure 10:
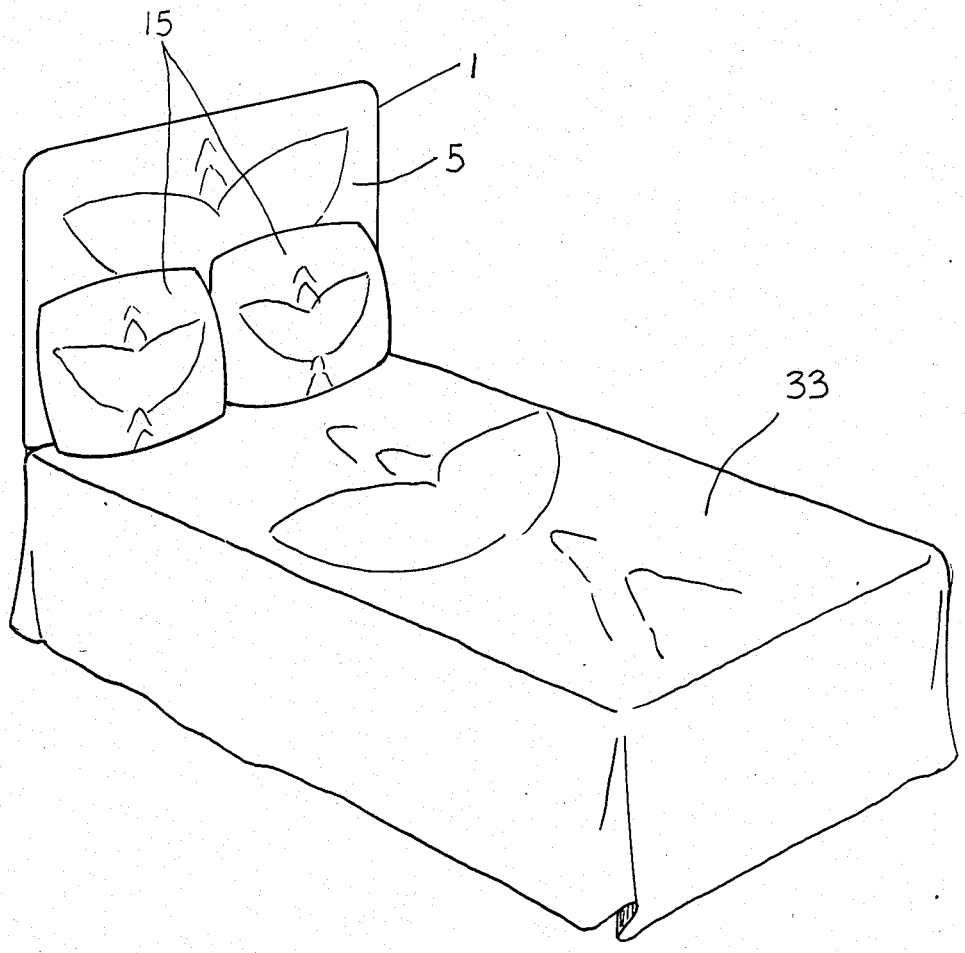
FIG. 10 of the drawings is a perspective view of a bed displaying a headboard, two pillows covered with pillow shams and a comforter in accordance with this invention.

Illustrated in FIG. 10 of the drawings is the headboard frame and sleeve 1 therefor in combination with a conventional bed covered with the invertible comforter 33 and enhanced by decorative pillows within pillow shams 15. As can be seen, the fabric frontal portion 5 of the headboard sleeve 1 co-ordinates in color, design and/or stitching pattern with the frontal portions of the pillow shams 15 and the exposed surface of the comforter 33. This is a decorating scheme not heretofore available within the prior art.

It is thus seen that this invention provides a plurality of novel decorative items for use in various combinations to provide alternatives in bedroom decor. In addition to the comforter which may be inverted to provide two distinct exterior patterns, decorative items having independently quilted and/or embroidered fabric sections and the co-ordination of the ornamental features of headboard sleeve, pillow shams and comforter distinguished this invention. It is further seen that this invention provides a novel process for co-ordinating and displaying various combinations of the decorative items and in particular provides a novel process for inverting a comforter of novel design to expose its finished interior surfaces. As variations of this invention will be apparent to those of skill in the art from a reading of the above specification, such variations are within the spirit and scope of this invention as defined by the following appended claims.

What is claimed is:

1. A plurality of decorative items for use with a conventional bed, comprising:

a headboard;

a fabric sleeve for said headboard, said sleeve having frontal and rearward portions thereof which complement and contribute to an overall decorative scheme by means of fabric color, design and/or stitching pattern to provide alternative display choices for decorative purposes;

pillow shams for covering decorative pillows to be placed near said headboard, said shams having frontal and rearward portions stitched together in the traditional manner to form a cavity therebetween for receipt of a pillow, said frontal and rearward portions complementing and contributing to an overall decorative scheme by means of fabric color, design and/or stitching pattern, and said frontal and rearward portions of said shams co-ordinating respectively with said frontal and rearward portions of said sleeve to provide alternative display choices for decorative purposes; and an invertible comforter which may be inverted to provide two distinct exterior patterns one of which co-ordinates with said frontal portions of said sleeve and shams and the other of which co-ordinates with said rearward portions of said sleeve and shams to complement and contribute to an overall decorative scheme by means of fabric color, design and/or stitching pattern to provide alternative display choices for decorative purposes the two exterior ornamental fabric portions of the comforter co-ordinating with or matching with each other, and the two interior ornamental fabric portions of the comforter co-ordinating with or matching with each other, said comforter comprising two distinct and like units, said units being positioned one above the other then stitched to each other along all four edges except for one short length along the edge to be positioned at the foot of the bed, thereby forming a cavity within the finished item and access to said cavity.

2. The decorative items in accordance with claim 1, each of said units comprising an upper quilted and/or embroidered fabric portion stitched along all four edges to a lower quilted and/or embroidered fabric portion of like size such that the ornamental features of each are toward the outside and the upper fabric portion of each unit co-ordinates with or matches the upper fabric portion of the other said unit, the lower fabric portion of each unit co-coordinates with or matches the lower fabric portion of the other said unit, and the upper fabric portions contrast to or differ in design, color and/or stitching pattern from the lower fabric portions.

3. The decorative items in accordance with claim 2 wherein the lower of said units is turned over to reverse its top and bottom surfaces prior to stitching the two units to each other.

4. The decorative items in accordance with claim 1 wherein said short length remaining unstitched provides means for manually inverting said comforter by allowing one to reach into said opening and pull the inside surfaces through to the outside thereby exposing the interior ornamental fabric portions.

5. The decorative items of claim 1 wherein said ornamental portions thereof comprise fabric sections which are independently quilted and/or embroidered, then stitched together so as to produce said accessories for a conventional bed.

6. The decorative items of claim 1 wherein specific combinations of displayed ornamental portions of the headboard fabric sleeve, pillow shams and comforter are co-ordinated to match and complement one another.

7. A process for co-ordinating and displaying various combinations of the decorative portions of accessories for a conventional bed comprising the steps of:

providing;

a headboard, a fabric sleeve for said headboard, said sleeve having frontal and rearward portions thereof which complement and contribute to an overall decorative scheme by means of fabric color, design and/or stitching pattern to provide alternative display choices for decorative purposes;

pillow shams for covering decorative pillows to be placed near said headboard, said shams having frontal and rearward portions stitched together in the traditional manner to form a cavity therebetween for receipt of a pillow, said frontal and rearward portions complementing and contributing to an overall decorative scheme by means of fabric color, design and/or stitching pattern, and said frontal and rearward portions of said shams co-ordinating respectively with said frontal and rearward portions of said sleeve to provide alternative display choices for decorative purposes; and an invertible comforter which may be inverted to provide two distinct exterior patterns one of which co-ordinates with said frontal portions of said sleeve and shams and the other of which co-ordinates with said rearward portions of said sleeve and shams to complement and contribute to an overall decorative scheme by means of fabric color, design and/or stitching pattern to provide alternative display choices for decorative purposes the two exterior ornamental fabric portions of the comforter co-ordinating with or matching with each other, and the two interior ornamental fabric portions of the comforter co-ordinating with or matching with each other, said comforter comprising two distinct and like units, said units being positioned one above the other then stitched to each other along all four edges except for one short length along the edge to be positioned at the foot of the bed, thereby forming a cavity within the finished item and access to said cavity; and inverting said comforter to expose the interior thereof to coordinate with said sleeve and shams and to remove from view the pattern previously on the exterior thereof.

* * * * *